US007407925B2

(12) United States Patent
Daschner et al.

(10) Patent No.: US 7,407,925 B2
(45) Date of Patent: Aug. 5, 2008

(54) PACKAGED DETERGENT COMPOSITION OR ADDITIVE AND METHOD FOR PACKAGING THE SAME

(75) Inventors: Natascha Daschner, Ludwigshafen (DE); Judith Preuschen, Ludwigshafen (DE); Ralf Wiedemann, Ludwigshafen (DE)

(73) Assignee: Reckitt Benckiser N.V., Hoofddorp (NL)

( * ) Notice: Subject to any disclaimer, the term of this patent is extended or adjusted under 35 U.S.C. 154(b) by 6 days.

(21) Appl. No.: 10/505,993

(22) PCT Filed: Mar. 5, 2003

(86) PCT No.: PCT/GB03/00898

§ 371 (c)(1), (2), (4) Date: Feb. 28, 2005

(87) PCT Pub. No.: WO03/074647

PCT Pub. Date: Sep. 12, 2003

(65) Prior Publication Data

US 2005/0143273 A1 Jun. 30, 2005

(30) Foreign Application Priority Data

Mar. 6, 2002 (GB) ..... 0205247.0

(51) Int. Cl.
*C11D 17/04* (2006.01)
*C11D 3/39* (2006.01)

(52) U.S. Cl. ..... 510/439; 510/220; 510/367; 206/524.5

(58) Field of Classification Search ..... 510/439, 510/220, 367; 206/524.5
See application file for complete search history.

(56) References Cited

U.S. PATENT DOCUMENTS

| | | | | | |
|---|---|---|---|---|---|
| 4,786,561 | A * | 11/1988 | Fong | 428/502 |
| 4,929,476 | A * | 5/1990 | Gibbons et al. | 428/34.2 |
| 5,604,042 | A * | 2/1997 | Bianchini et al. | 428/507 |
| 5,628,950 | A * | 5/1997 | Schrenk et al. | 264/241 |
| 5,846,620 | A * | 12/1998 | Compton | 428/35.7 |
| 5,962,092 | A * | 10/1999 | Kuo et al. | 428/34.9 |
| 6,294,210 | B1 | 9/2001 | Kuo | 426/127 |
| 6,630,438 | B1 * | 10/2003 | Arnau et al. | 510/439 |
| 6,649,235 | B2 * | 11/2003 | Prasad | 428/34.7 |
| 6,846,794 | B1 * | 1/2005 | Ingram et al. | 510/446 |
| 6,858,676 | B1 * | 2/2005 | Johoji et al. | 525/191 |
| 6,921,563 | B2 * | 7/2005 | Goerlitz et al. | 428/34.2 |

FOREIGN PATENT DOCUMENTS

| | | | |
|---|---|---|---|
| DE | 4344205 | A1 | 6/1995 |
| DE | 198 48 457 | A | 4/2000 |
| EP | 0 649 737 | A | 4/1995 |
| EP | 0 899 208 | A | 3/1999 |
| EP | 0 903 405 | A | 3/1999 |
| WO | WO 99/11540 | | 3/1999 |
| WO | WO 00/55287 | A2 * | 9/2000 |
| WO | WO 01/07703 | | 2/2001 |
| WO | WO 01/64829 | A1 * | 9/2001 |
| WO | WO 01 66421 | A | 9/2001 |

* cited by examiner

*Primary Examiner*—Lorna M Douyon
(74) *Attorney, Agent, or Firm*—Norris McLaughlin & Marcus, PA

(57) ABSTRACT

A packaged detergent composition and/or additive comprises at least one oxygen releasing compound for use with a device for dispensing and/or dosing the detergent composition and/or additive into an automatic dishwashing machine over a plurality of washing cycles, wherein the package is made of a material with an oxygen transfer rate of more than 10 $cm^3/m^2/bar/24$ h, preferably more than 50 $cm^3/m^2/bar/24$ h, and most preferably more than 100 $cm^3/m^2/bar/24$ h, measured at 23° C. and 0% Equilibrium Relative Humidity. A method of packaging the detergent composition and/or additive is also described.

17 Claims, No Drawings

PACKAGED DETERGENT COMPOSITION OR ADDITIVE AND METHOD FOR PACKAGING THE SAME

This application is a 371 of PCT/GB03/00898 filed Mar. 5, 2003 which claims priority under 35 U.S.C. 119 to United Kingdom Application No. 0205247.0 filed Mar. 6, 2002.

The present invention relates to a novel use of a package material with a specified minimum oxygen transfer rate, to a package for a specified detergent composition and/or additive made of such package material, and to a product packaged in such a package.

In known automatic dishwashing machines, the detergent, whether in powder, tablet or gel form, is usually filled manually by the user into the machine, in particular into a detergent holder, before each dishwashing operation. Because of the necessity of handling the dishwashing detergent each and every time when a dishwashing cycle is to be started, this filling process is inconvenient, even with detergents in tablet form, when the problem of exact metering of the detergent and possible spillage thereof is avoided, which is an additional problem for powder and gel detergents. Moreover, even with careful handling, direct contact of the detergent with the user's skin is difficult to avoid in the usual filling process, which is again inconvenient because of the nature of the detergent compositions.

From the prior art, a number of devices are known for dispensing and/or dosing detergent compositions into an automatic dishwashing machine over a plurality of washing cycles.

From DE 4344205A1, a device for dispensing of detergent tablets is known. The dosing device disclosed therein is mounted on the door of a dishwashing machine and loaded with a number of detergent tablets. The dosing device has an ejector for dispensing a single tablet each time the dishwashing machine is used. In a preferred embodiment, the dosing device has a reception shaft for receiving the detergent tablets one after the other, with the ejector being located at the bottom end of the shaft. It is mentioned that a package holding the detergent additive in singular closed cells could be placed into the dishwashing machine as a whole and that unit doses of the detergent additive could be ejected from this package by pressing them through a thin cover foil.

WO 01/07703 discloses a device for the dosed release of a detergent composition or additive into a dishwashing machine having a number of separate closed chambers for holding a detergent composition and means for opening the chambers, activated by conditions within the machine.

In WO 99/11540, a packaging system for a stack of tablets containing a bleaching agent is described. The problem is mentioned that, if usual packaging materials, such as known from food industry, are used, when gas may be released within the package from the bleaching agent without being evacuated, such packaging system will be deformed, in extreme cases, leading to explosion thereof. WO 99/11540 proposes to use, as a material for the packaging system for such bleaching agent containing tablets, one having a very low moisture vapour transfer rate to strictly limit the ingress of water into the packaging system so that stability of the bleaching agent can be maintained. As an additional measure it is proposed to provide for at least a micro-hole in the packaging system to allow egress of gas to the environment, if formed within the package.

According to Applicant's experience, detergent compositions and additives comprising oxygen releasing compounds such as bleaching agents, e.g. percarbonates, perborates, hydrogen peroxide, organic peroxides and the like, are usually found to be stable under normal storage tests and do not tend to release any gas. Such storage tests are usually performed at conditions such as 30° C. and 50% Equilibrium Relative Humidity, or 40° C. and 70% Equilibrium Relative Humidity. If detergent compositions and additives are to be supplied to specific countries, storage tests at even 50° C. for one week are performed.

Applicants have now surprisingly identified the problem that detergent compositions and/or additives comprising oxygen releasing compounds may release oxygen gas, even without coming into contact with moisture, water or wash liquor, if the packaged product is used in a device for dispensing it over a plurality of washing cycles, i.e. when the device—and the packaged product within the device—would stay in the automatic dishwashing machine for more than one washing cycle. This is especially surprising when using compositions having a relatively low content of oxygen gas releasing compounds, for example, compositions having an active oxygen content of less than 3 wt.-%, preferably less than 2.5 wt.-%, most preferably less than 2 wt.-%, as such compositions usually do not show any significant tendency to release any oxygen gas under storage test conditions. Actually, normal conditions in a dishwashing machine of usually at least 40° C., more usually at least 50° C., very often more than 60° C., and even more than 70° C., and of an Equilibrium Relative Humidity of up to 100%, now have been found to cause specific problems. Under those conditions, usual packages, in particular blister packs, which are normally made from PVC or coated PVC, but also of other polymeric material, alone or in combination with aluminum foil, would run the risk of expansion of the package or compartments thereof holding the detergent composition, and in the extreme destruction or explosion of the package material by the generation of oxygen gas from the oxygen releasing compound(s). Even a packaging system, as described in WO 99/11540 could not provide for a satisfactory and reliable solution, as the micro-holes tend to clog over a plurality of washing cycles or might be the reason for the break of the package material in that region.

It is therefore an object of the present invention to avoid these problems and to provide for an improved packaging system for detergent compositions and/or additives comprising at least one oxygen-releasing compound being stable over a plurality of washing cycles.

The object is solved by the use of a material with an oxygen transfer rate of more than 10 $cm^3/m^2/bar/24$ h, preferably more than 50 $cm^3/m^2/bar/24$ h, and most preferably more than 100 $cm^3/m^2/bar/24$ h, measured at 23° C. and 0% Equilibrium Relative Humidity, for packaging at least one detergent composition and/or additive comprising at least one oxygen releasing compound for use with a device for dispensing and/or dosing said detergent composition and/or additive into an automatic dishwashing machine over a plurality of washing cycles.

Usually, there are conditions, in the automatic dishwashing machine, of a temperature of higher than 40° C., preferably 50° C., more preferably 60° C., even more preferably 65° C., and most preferably 70° C., and a relative humidity of up to 100%.

In a preferred embodiment, the material has a moisture vapour transfer rate of less than 20 $g/m^2/24$ h, more preferably less than 15 $g/m^2/24$ h, and most preferably less than 10 $g/m^2/24$ h, measured at 25° C. and 50% Equilibrium Relative Humidity.

In a further preferred embodiment, the material is stable at 90° C., more preferably at 80° C., most preferably at 70° C. for more than 24 h, preferably for more than 48 h.

In another preferred embodiment of the invention, the material is stable at both high and low pH values, preferably up to pH 13 and down to pH 2, and most preferably up to pH 14 and down to pH 1.

Most preferably, the material is a copolymer on the basis of cyclic olefins and linear olefins.

In a preferred embodiment, the detergent composition and/or additive has an active oxygen content of less than 3 wt.-%, preferably less than 2.5 wt.-%, most preferably less than 2 wt.-%.

The invention is also related to a package for receiving and holding at least one detergent composition and/or additive comprising at least one oxygen releasing compound for use with a device for dispensing and/or dosing said detergent composition and/or additive into an automatic dishwashing machine over a plurality of washing cycles, wherein the package is made, at least partially, of a material being oxygen permeable with an oxygen transfer rate of more than 10 $cm^3/m^2/bar/24$ h, preferably more than 50 $m^3/m^2/bar/24$ h, and most preferably more than 100 $cm^3/m^2/bar/24$ h, measured at 23° C. and 0% Equilibrium Relative Humidity.

Preferably, the material has a moisture vapour transfer rate of less than 20 $g/m^2/24$ h, more preferably less than 15 $g/m^2/24$ h, and most preferably less than 10 $g/m^2/24$ h, measured at 25° C. and 50% Equilibrium Relative Humidity.

In a preferred embodiment, the material is stable at 90° C., more preferably at 80° C., most preferably at 780° C. for more than 24 h, preferably for more than 48 h, and/or at both high and low pH values, preferably up to pH 13 down to pH 12, and most preferably up to pH 14 and down to pH 1.

In a further preferred embodiment, the material is a copolymer on the basis of cyclic olefins and linear olefins.

In a preferred embodiment, the package is a blister pack with a plurality of compartments for receiving unit doses of the detergent composition and/or additive.

In preferred embodiments of the invention, the blister pack has a sufficient mechanical stability under the washing conditions in the dishwashing machine and/or is fitting geometrically in the dishwashing machine, in particular in the plate space of the lower rack thereof.

The invention is also related to a packaged detergent composition and/or additive comprising at least one oxygen-releasing compound characterized by a package according to the invention.

The problem underlying this invention, as identified herein-above, is solved in a surprisingly simple and reliable way when choosing a packaging material meeting the criteria of a minimum oxygen transfer rate as defined herein-above. By choosing a respective material, destruction or explosion of detergent composition holding packs or compartments of a blister pack could be completely avoided, even when staying in a dishwashing machine over a plurality of washing cycles and being subjected to the respective elevated temperatures of up to more than 70° C.

Although there are a number of materials meeting this criteria of oxygen permeability (and preferably also of moisture vapour breathability and temperature and pH stability), which are available for someone skilled in the art, copolymers on the basis of cyclic olefins and linear olefins are preferred. The presently most preferred material is available under the tradename TOPAS® from Ticona GmbH, Germany. Compounds from the TOPAS® series are amorphous, transparent copolymers on the basis of cyclic olefins and linear olefins. The chemical structure of these copolymers result in a specific property profile, including an oxygen transmission rate as required for the blister pack of the present invention, but also low density, high transparency, low birefringence, extremely low water absorption, remarkable water vapour barrier properties, graded heat distortion temperature (HDT/B) up to 170° C., high rigidity, strength and hardness, excellent biocompatibility, good resistance to acids and alkalis, i.e. to pH values at the low and at the high end, and very good processability and flow properties.

Up to now, this material has been used in medical devices and diagnostic disposables, optics, optical data storage, packaging of pharmaceuticals and as a toner binder resin.

Use of the material for blister packs of the above-identified type has not been proposed.

As an example, TOPAS Film Grade 6013 has a oxygen transfer rate (OTR) of 400 $cm^3/m^2/bar/24$ h at 23° C. in 0% Equilibrium Relative Humidity and a moisture vapour transfer rate (MVTR) of 0.4 $g/m^2/24$ h at 25° C. in 50% Equilibrium Relative Humidity. TOPAS Film Grade 8007 has an OTR of 200 $cm^3/m^2/bar/24$ h and a MVTR of 0.28 $g/m^2/24$ h.

OTR has been measured according to ASTM Method D1434-82 (1989), being a standard test method for determining gas permeability characteristics of plastic film and sheeting. MVTR has been measured according to ASTM Method F 372-99, being a standard test method for water vapour transfer rate of flexible barrier materials using an infrared detection technique.

Therefore, the material perfectly meets the requirements of a blister pack material of the present invention. However, the invention is clearly not limited to the use of this specific material and other materials are or might become available meeting the same criteria.

The features disclosed in the foregoing description and/or claims may both separately and in any combination thereof be material for realizing the invention in diverse forms thereof.

The invention claimed is:

1. Method of packaging at least one detergent composition or additive comprising at least one oxygen releasing compound for use with a device placed in the interior of the dishwashing or washing machine for dispensing or dosing said detergent composition or additive into an automatic dishwashing machine over a plurality of washing cycles comprising the step of receiving and holding the at least one detergent composition or additive in a material that is a copolymer on the basis of cyclic olefins and linear olefins with an oxygen transfer rate of more than 10 $cm^3/m^2/bar/24$ h, measured at 23° C. and 0% Equilibrium Relative Humidity.

2. The method according to claim 1 wherein the material has a moisture vapour transfer rate of less than 20 $g/m^2/24$ h, measured at 25° C. and 50% Equilibrium Relative Humidity.

3. The method according to claim 1 wherein the material is stable at 90° C. for more than 24 h.

4. The method according to claim 1, wherein the material is stable within the pH range of from pH 13 to pH 2.

5. The method according to claim 1 wherein the detergent composition or additive has an active oxygen content of less than 3 wt.-%.

6. A packaged detergent composition and/or additive composition and/or additive comprising at least one oxygen releasing compound for use with a device for dispensing or dosing said detergent composition or additive into an automatic dishwashing machine over a plurality of washing cycles, wherein the package is made of a material consisting of a copolymer on the basis of cyclic olefins and linear olefins being oxygen permeable with an oxygen transfer rate of more than 10 $cm^3/m^2/bar/24$ h, measured at 23° C. and 0% Equilibrium Relative Humidity.

7. The packaged detergent composition and/or additive according to claim 6, wherein there are conditions, in the automatic dishwashing machine of a temperature of higher than 40° C., and a relative humidity of from 10% to 100%.

8. The packaged detergent composition according to claim 6, wherein the material has a moisture vapour transfer rate of less than 20 $g/m^2/24$ h, measured at 25° C. and 50% Equilibrium Relative Humidity.

9. Package according to claim 6 wherein the material is stable at 90° C.

10. Package according to claim 6 wherein the material is stable within the pH range of pH 13 to pH 12.

11. Package according to claim 6, wherein the detergent composition or additive has an active oxygen content of less than 3 wt.-%.

12. Package according to claim 6 wherein the package is a blister pack with a plurality of compartments for receiving unit doses of the detergent composition and/or additive.

13. The packaged detergent composition and/or additive according to claim 12, wherein the blister pack has a sufficient mechanical stability under the washing conditions in the dishwashing machine.

14. The packaged detergent composition and/or additive according to claim 12, wherein the blister pack fits geometrically in the dishwashing machine.

15. The packaged detergent composition and/or additive according to claim 14, wherein the blister pack fits in the plate space of the lower rack of the dishwashing machine.

16. The packaged detergent composition and/or additive according to claim 6 wherein the material is stable at 80° C. for more than 24 h.

17. The packaged detergent composition and/or additive according to claim 6 wherein the material is stable at 70° C. for more than 24 h.

* * * * *